US010985456B1

(12) United States Patent
Chukka et al.

(10) Patent No.: US 10,985,456 B1
(45) Date of Patent: Apr. 20, 2021

(54) ANTENNA SYSTEM FOR WIRELESS NETWORKS

(71) Applicant: Sprint Communications Company L.P., Overland Park, KS (US)

(72) Inventors: Chaitanya Chukka, Overland Park, KS (US); Andrew Mark Wurtenberger, Olathe, KS (US); Patrick Jacob Schmidt, Basehor, KS (US); Matthew Masters, Greenfield, IN (US)

(73) Assignee: Sprint Communications Company L.P., Overland Park, KS (US)

( * ) Notice: Subject to any disclaimer, the term of this patent is extended or adjusted under 35 U.S.C. 154(b) by 228 days.

(21) Appl. No.: 16/353,838

(22) Filed: Mar. 14, 2019

Related U.S. Application Data

(62) Division of application No. 15/058,987, filed on Mar. 2, 2016, now Pat. No. 10,276,933.

(51) Int. Cl.

| | |
|---|---|
| ***H01Q 3/04*** | (2006.01) |
| ***H01Q 1/24*** | (2006.01) |
| ***H01Q 5/30*** | (2015.01) |

(52) U.S. Cl.
CPC ..... *H01Q 3/04* (2013.01); *H01Q 1/246* (2013.01); *H01Q 5/30* (2015.01)

(58) Field of Classification Search
CPC ..... H01Q 1/246; H01Q 3/06; H01Q 5/30
See application file for complete search history.

(56) References Cited

U.S. PATENT DOCUMENTS

| | | | | |
|---|---|---|---|---|
| 2005/0134512 | A1 | 6/2005 | Gottl et al. | |
| 2009/0274130 | A1 | 11/2009 | Boch | |
| 2015/0144758 | A1* | 5/2015 | Kolokotronis | H01Q 1/1242 248/282.1 |
| 2016/0285149 | A1* | 9/2016 | Au | H01Q 1/246 |
| 2016/0352042 | A1* | 12/2016 | Wankoff | H01Q 1/246 |
| 2016/0365624 | A1 | 12/2016 | Maley et al. | |

* cited by examiner

*Primary Examiner* — Daniel Munoz

(57) ABSTRACT

An antenna system for a wireless network that provides multi-band and/or multi-sector operation from a single location is provided. The antenna system may provide improved control and adjustment of antennas contained within a compact design to allow sectors of coverage provided by the antennas to be modified to accommodate different cell site parameters that may otherwise have been satisfied using a more distributed arrangement of antennas.

20 Claims, 9 Drawing Sheets

ANTENNA SYSTEM FOR WIRELESS NETWORKS

CROSS-REFERENCE TO RELATED APPLICATIONS AND PRIORITY CLAIM

This application is a divisional that claims priority to co-pending U.S. patent application Ser. No. 15/058,987, filed Mar. 2, 2016, titled "Antenna System for Wireless Networks," the contents of which are incorporated herein by reference in the entirety.

TECHNICAL FIELD

The present technology relates to antennas for wireless networks.

SUMMARY

This summary is intended to introduce a selection of concepts in a simplified form that are further described below in the detailed description section of this disclosure. This summary is not intended to identify key or essential features of the claimed subject matter, nor is it intended to be used as an aid in determining the scope of the claimed subject matter.

In brief, and at a high level, this disclosure describes, among other things, an antenna system for a wireless network that allows multi-band and/or multi-sector operation from a single location. Furthermore, the antenna system may provide improved control and adjustment of antennas contained within a compact design to allow sectors of coverage provided by the antennas to be modified to accommodate different cell site parameters which may otherwise have been satisfied using a more distributed arrangement of antennas.

In one embodiment, an adjustable antenna system for use in a wireless communications network is provided, in accordance with an embodiment of the present technology. The system comprises an antenna housing rotatably coupled to a base, the housing comprising a first antenna movably coupled to the housing, the first antenna providing a first sector of coverage that comprises at least one frequency band, and a second antenna movably coupled to the housing, the second antenna providing a second sector of coverage that comprises the at least one frequency band. The first and second antennas are movable in unison through rotation of the antenna housing, and the first and second antennas are each independently movable relative to the housing.

In another embodiment, a method of assembling an antenna system for use in a wireless communications network is provided, in accordance with an embodiment of the present technology. The method comprises providing an antenna housing, providing a base, rotatably coupling the antenna housing to the base, movably coupling a first antenna to the housing, the first antenna configured to provide a first sector of coverage, and movably coupling a second antenna to the housing, the second antenna configured to provide a second sector of coverage.

In another embodiment, a method of configuring an antenna system in a wireless communications network is provided, in accordance with an embodiment of the present technology. The method comprises providing an antenna housing, providing a base, rotatably coupling the antenna housing to the base, movably coupling a first antenna to the housing, the first antenna providing a first sector of coverage, movably coupling a second antenna to the housing, the second antenna providing a second sector of coverage, and movably coupling a third antenna to the housing, the third antenna providing a third sector of coverage. The method further comprises adjusting at least one of the first, second, and third sectors of coverage by performing at least one of rotating the housing from a first position to a second position relative to the base to move the first, second, and third antennas in unison, and moving at least one of the first, second, and third antennas relative to the housing.

The term "antenna" as used herein may comprise any component used in a wireless communications network that is configured to broadcast and/or receive a wireless communications signal, including one comprising one or more frequency bands.

BRIEF DESCRIPTION OF THE DRAWINGS

The present technology is described in detail herein with reference to the attached drawing figures, which are intended to be exemplary and non-limiting, wherein.

DETAILED DESCRIPTION

The subject matter of the present technology is described with specificity in this disclosure to meet statutory requirements. However, the description is not intended to limit the scope. Rather, the claimed subject matter may be embodied in other ways, to include different steps, combinations of steps, features, or combinations of features, similar to the ones described in this disclosure, and in conjunction with other present or future technologies. Moreover, although the terms "step" and/or "block" may be used to identify different elements of methods employed, the terms should not be interpreted as implying any particular order among or between various steps or blocks unless and except when the order of individual steps or blocks is explicitly described and required.

At a high level, the present technology relates generally to antennas and antenna systems used in wireless networks. More specifically, a compact antenna system with antennas configured to be adjusted in unison and/or adjusted individually to customize sectors of coverage from a cell site is provided. The compact configuration may allow reduced zoning, leasing, and operational requirements, and may provide a more appealing and less technical aesthetic, among other benefits. Various aspects of the antenna system are described in detail below with respect to FIGS. 1-10.

Figure 1:
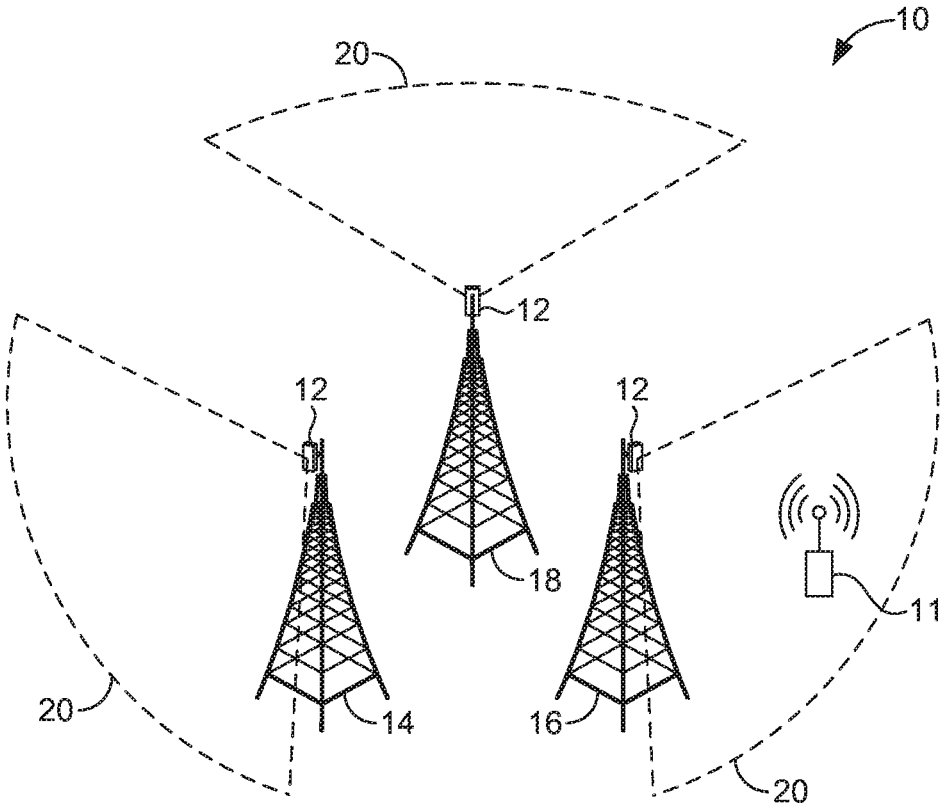
FIG. 1 is an exemplary antenna system for a wireless network, in accordance with an embodiment of the present technology.

Referring to FIG. 1, an antenna system 10 used in a wireless network is provided, in accordance with an embodiment of the present technology. In FIG. 1, the antenna system 10 includes multiple antennas 12 positioned at separate antenna locations 14, 16, and 18. The antennas 12 provide respective sectors of coverage 20 within which a mobile device 11 may be served.

Figure 2:
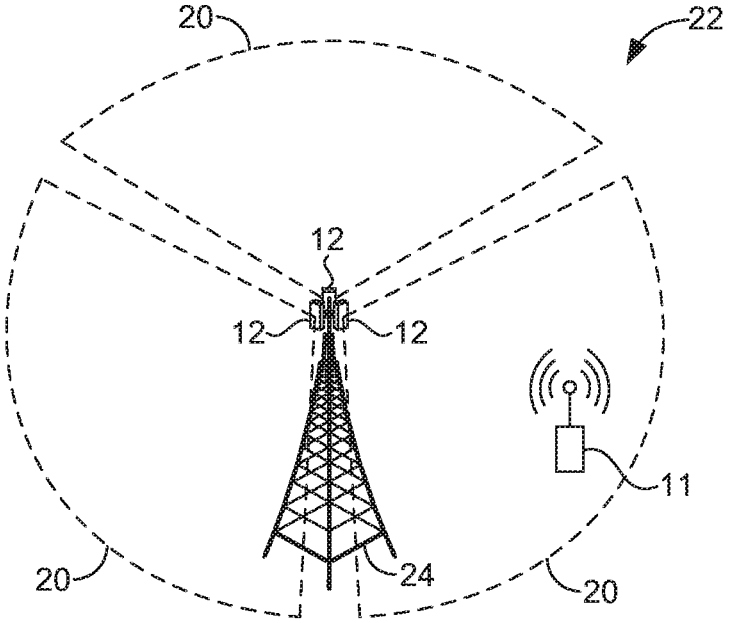
FIG. 2 is another exemplary antenna system for a wireless network, in accordance with an embodiment of the present technology.

Referring to FIG. 2, a more consolidated antenna system 22 used in a wireless network is provided, in accordance with an embodiment of the present technology. The antenna system 22 shown in FIG. 2 includes the antennas 12, as with FIG. 1. However, in contrast to FIG. 1, the antennas 12 in the antenna system 22 shown in FIG. 2 are positioned in closer proximity to each other at antenna location 24 to provide the sectors of coverage 20 from a more consolidated location. As a result, efficient use of equipment, as well as reduced zoning and land-leasing requirements, may be possible.

Figure 3:
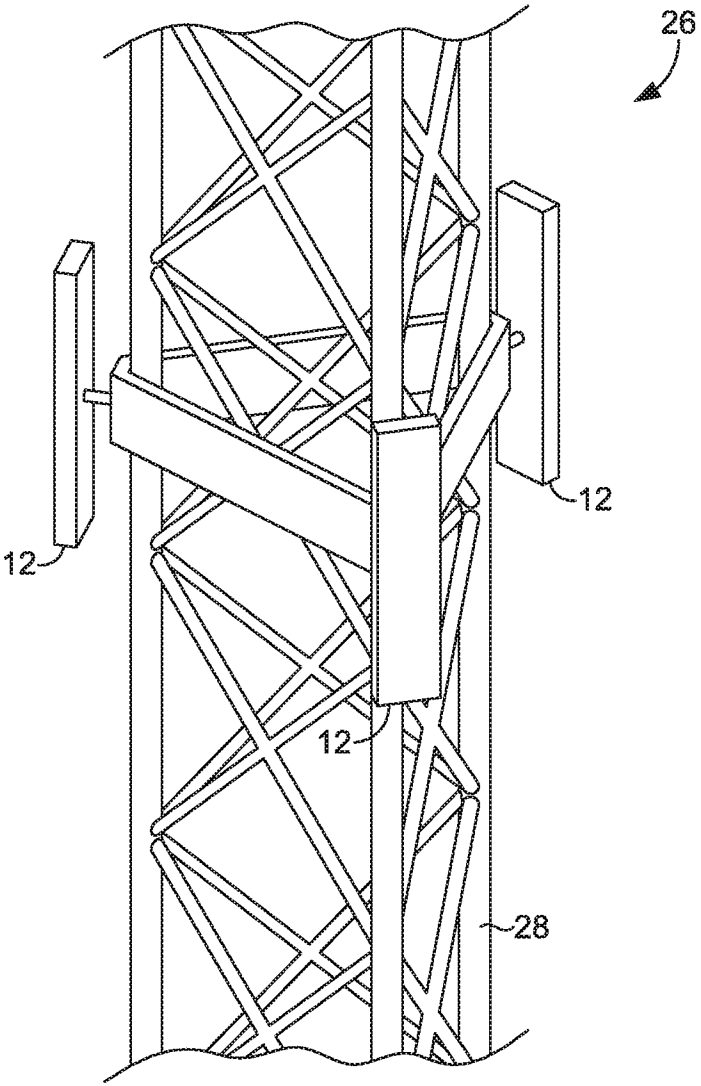
FIG. 3 is an exemplary antenna system with separated antennas, in accordance with an embodiment of the present technology.

Referring to FIG. 3, an exemplary antenna system 26 with separated antennas 12 for a wireless network is provided, in accordance with an embodiment of the present technology. The antenna system 26 shown in FIG. 3 includes a tower structure 28 to which the antennas 12 are coupled. The design of the antenna system 26 in FIG. 3 may allow for a more consolidated operation of antennas 12, as discussed with respect to FIG. 2. Additionally, the antennas 12 are coupled to the tower structure 28 at individual exterior locations, which allows greater flexibility for adjusting elevation and azimuth of the sectors of coverage provided by the antennas 12, due at least in part to the surrounding space.

Figure 4:
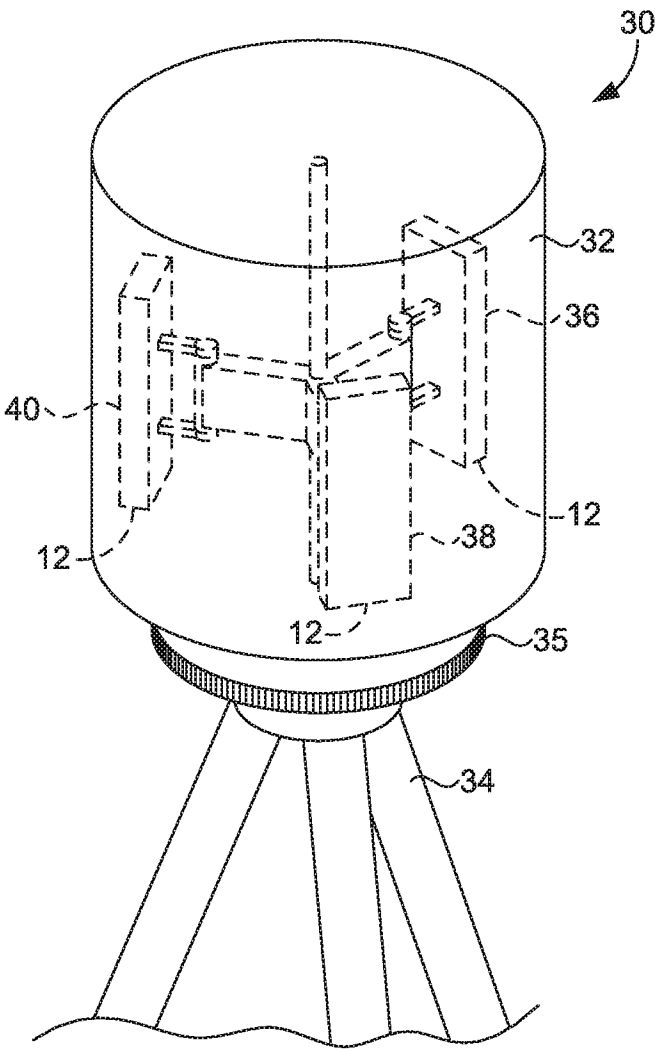
FIG. 4 is an exemplary antenna system with a compact configuration of antennas, in accordance with an embodiment of the present technology.

Referring to FIG. 4, an exemplary compact antenna system 30 for a wireless network is provided, in accordance with an embodiment of the present technology. The antenna system 30 includes a housing 32 coupled to a base 34 with a rotatable coupling 35, and a plurality of antennas 12 enclosed within the housing 32. The housing 32 is rotatable relative to the base 34 via the rotatable coupling 35. The interior components of the compact antenna system 30 are depicted with dotted lines in FIG. 4 for reference, as they may be at least partially obscured by the housing 32. The housing 32 may thus help provide a more consolidated, streamlined, and less technical aesthetic.

The housing 32 shown in FIG. 4 includes a canister-type construction, but other types of housing constructions may be used as well. Alternative shapes or coverings (e.g., tubular, square, ovular, half-moon shaped, etc.) are possible and contemplated. The antennas 12 within the housing 32 further comprise a first antenna 36 that provides a first sector of coverage, a second antenna 38 that provides a second sector of coverage, and a third antenna 40 that provides a third sector of coverage. Although three antennas are depicted in FIG. 4, in implementation, more or fewer antennas may be utilized, as needed to satisfy the coverage requirements. By providing the sectors of coverage from within the housing, only an outside of the canister may be visible, and a less technical aesthetic may result.

Figure 5:
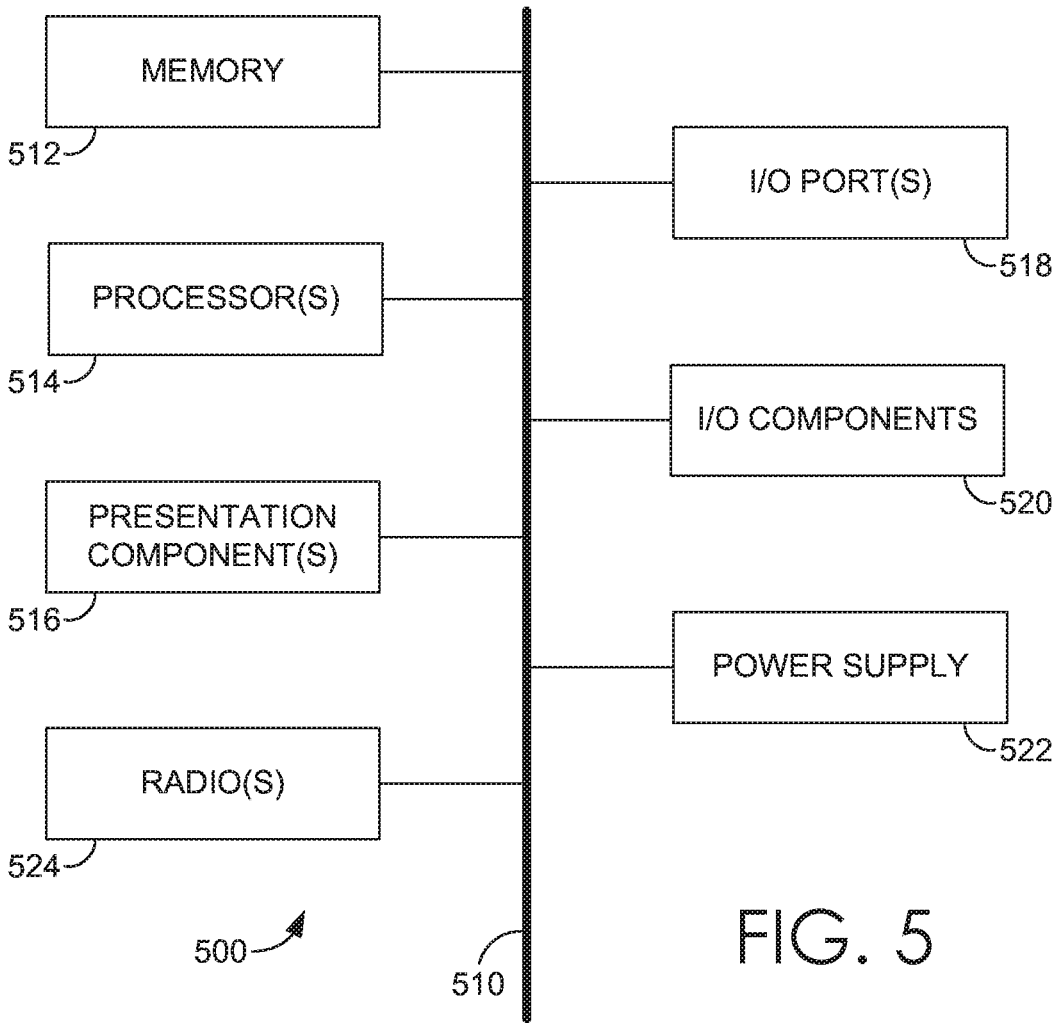
FIG. 5 is an exemplary computing environment that can be used with an antenna in a wireless network, in accordance with an embodiment of the present technology.

Referring to FIG. 5, an exemplary operating environment for use with embodiments of the technology is designated generally as computing device 500, in accordance with an embodiment of the present technology. Computing device 500 is but one example of a suitable computing environment and is not intended to suggest any limitation as to the scope of use or functionality of the technology, nor should the computing device 500 be interpreted as having any dependency or requirement relating to any one or a combination of components illustrated herein.

The technology may be described in the general context of computer code or machine-useable instructions, including computer-executable instructions such as program modules, being executed by a computer or other machine, such as a personal data assistant or other handheld device. Generally, program modules including routines, programs, objects, components, data structures, etc., refer to code that performs particular tasks or implements particular abstract data types. The technology may be practiced in any variety of system configurations, including hand held devices, consumer electronics, general-purpose computers, and more specialty computing devices, among others. The technology may also be practiced in distributed computing environments where tasks are performed by remote-processing devices that are linked through a communications network.

With reference to FIG. 5, computing device 500 includes a bus 510 that directly or indirectly couples the following devices: memory 512, one or more processors 514, one or more presentation components 516, input/output (I/O) ports 518, I/O components 520, and an illustrative power supply 522. Bus 510 represents what may be one or more busses (such as an address bus, data bus, or a combination thereof). Although the various blocks of FIG. 5 are shown with lines for the sake of clarity, in reality, delineating various components is not as clear, and metaphorically, the lines are blurred. For example, one may consider a presentation component such as a display device to be an I/O component. Also, processors have memory. The diagram of FIG. 5 is merely illustrative of an exemplary computing device that can be used in connection with one or more embodiments of the present technology. Distinction is not made between such categories as "workstation," "server," "laptop," "hand held device," etc., as all are contemplated as within the scope of FIG. 5 and when referencing the "computing device."

Computing device 500 may include a variety of computer-readable media and/or computer storage media. Computer-readable media may be any available media that can be accessed by computing device 500 and includes both volatile and nonvolatile media, removable and non-removable media. By way of example and not limitation, computer-readable media may comprise computer storage media and communication media and/or devices. Computer storage media may include volatile and nonvolatile, removable and non-removable media implemented in any method or technology for storage of information such as computer-readable instructions, data structures, program modules, or other data.

Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computing device 500. These memory components can store data momentarily, temporarily, or permanently. Computer storage media do not include signals per se.

Communication media may embody computer-readable instructions, data structures, program modules, or other data in a modulated data signal such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared, and other wireless media. Combinations of any of the above should also be included within the scope of computer-readable media.

Memory 512 includes computer storage media in the form of volatile and/or nonvolatile memory. The memory may be removable, non-removable, or a combination thereof. Exemplary hardware devices include solid-state memory, hard drives, optical-disc drives, etc. Computing device 500 includes one or more processors 514 that read data from various entities such as memory 512 or I/O components 520. Presentation component(s) 516 present data indications to a user or other device. Exemplary presentation components include a display device, speaker, printing component, vibrating component, etc. I/O ports 518 allow computing device 500 to be logically coupled to other devices including I/O components 520, some of which may be built-in. Illustrative components include a microphone, joystick, game pad, satellite dish, scanner, printer, wireless device, and the like.

Embodiments of the technology may be embodied as, among other things, a method, system, or computer-program product. Accordingly, the embodiments may take the form of a hardware embodiment, or an embodiment combining software and hardware. In one embodiment, the present technology takes the form of a computer-program product that includes computer-useable instructions embodied on one or more computer-readable media or devices.

Figure 6A:
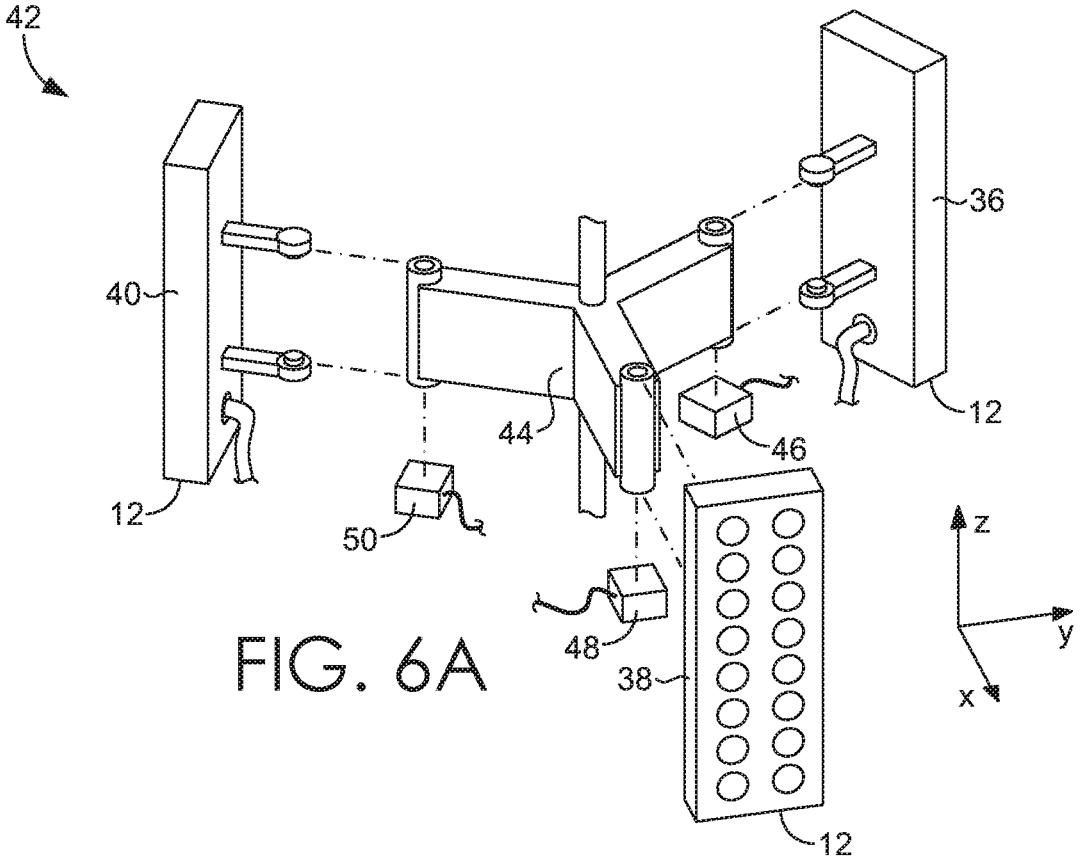
FIG. 6A is an exploded view of an exemplary compact antenna system, in accordance with an embodiment of the present technology.

Referring to FIG. 6A, an exploded view of a compact antenna system 42 is provided, in accordance with an embodiment of the present technology. In FIG. 6A, the plurality of antennas 12, as depicted similarly in FIG. 4, including the first, second, and third antennas 36, 38, and 40, are provided. The antennas 36, 38, and 40 are coupled to a support structure 44, which may be coupled to the housing 32 and base 34 shown in FIG. 4. Each of the first, second, and third antennas 36, 38, and 40 may be configured to transmit and/or receive a plurality of frequency bands over a respective sector of coverage.

Additionally, as shown in FIG. 6A, the first, second, and third antennas 36, 38, and 40 are individually movably coupled to the housing 32 at the support structure 44, such that the orientation of the respective antennas 36, 38, and 40 may be adjusted to modify the respective sector of coverage (e.g., x-y plane for azimuth; y-z plane for elevation). The first, second, and third antennas 36, 38, and 40 further include respective first, second, and third movement mechanisms 46, 48, and 50 for adjusting the orientation of the first, second, and third antennas 36, 38, and 40. The range of adjustment of the first, second, and third antennas 36, 38, and 40 may vary depending on the needed flexibility of the corresponding cell site and available space within the housing 32.

The movement mechanisms 46, 48, and 50 may be manually operable mechanisms that can be adjusted to a predetermined position and fixed, and/or may be automatically operable mechanisms that can be adjusted with one or more actuators contained therein or coupled thereto. The one or more actuators may comprise mechanical, electrical, pneumatic, and/or hydraulic actuators, or some other type of actuator, and may include a linkage assembly, gear assembly, belt assembly, etc. Although the first, second, and third movement mechanisms 46, 48, and 50 shown in FIG. 6A allow adjustment in the x-y plane, the first, second, and third movement mechanisms 46, 48, and 50 may be configured with additional articulation to allow adjustment in multiple planes (e.g., y-z plane for elevation), as discussed with respect to FIGS. 7A-7C.

Figure 6B:
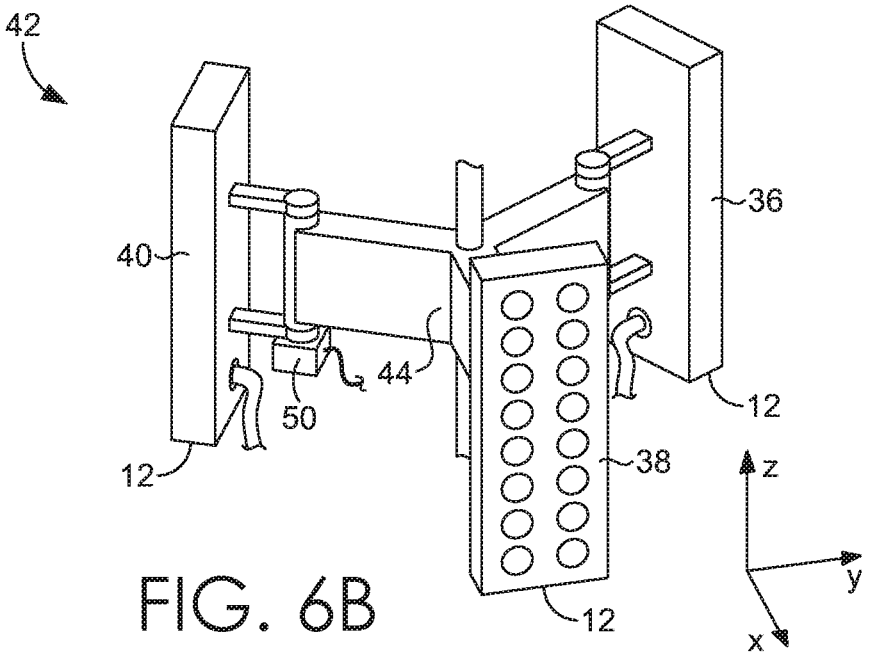
FIG. 6B is a non-exploded view of the exemplary compact antenna system depicted in FIG. 6A, in accordance with an embodiment of the present technology.

Referring to FIG. 6B, a non-exploded view of the compact antenna system 42 shown in FIG. 6A is provided, in accordance with an embodiment of the present technology. As shown in FIG. 6B, the first, second, and third antennas 36, 38, and 40 may be coupled to a housing through the central support 44, including through the respective first, second, and third movement mechanisms 46, 48, and 50, which are configured to rotate, or pivot, the respective antennas 36, 38, and 40 to adjust the sectors of coverage provided by the respective antennas 36, 38, and 40. The antennas 36, 38, and 40 each further comprise a plurality of ports, which can be used for transmitting and receiving a plurality of signal frequency bands.

Figure 6D:
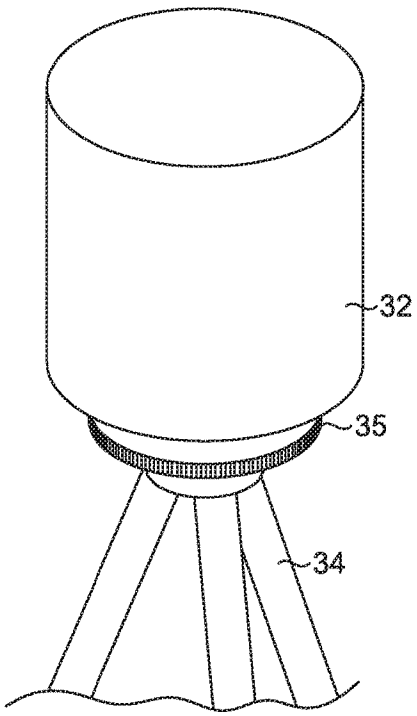
FIG. 6D is a non-exploded view of the exemplary housing and base depicted in FIG. 6C, in accordance with an embodiment of the present technology.
Figure 6C:
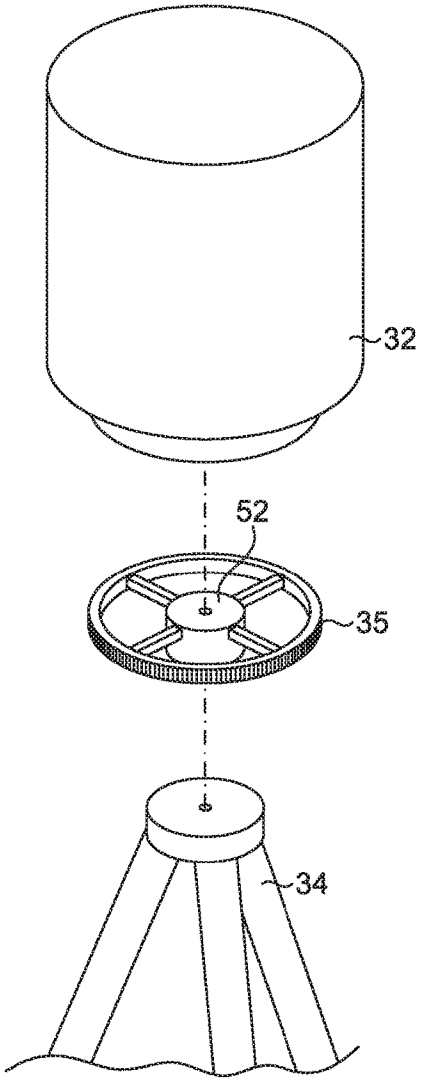
FIG. 6C is an exploded view of an exemplary housing and base for the compact antenna system shown in FIGS. 6A and 6B, in accordance with an embodiment of the present technology.

Referring now to FIG. 6C, an exploded view of the exemplary housing 32 and base 34 within which the compact antenna system 42 shown in FIGS. 6A and 6B may be enclosed is provided, in accordance with an embodiment of the present technology. In FIG. 6C, the housing 32 comprises a canister-like shape which may at least partially obscure and enclose the first, second, and third antennas 36, 38, and 40, while still allowing sufficient adjustability of the orientation of the first, second, and third antennas 36, 38, and 40 within the housing 32. Further, the central support 44 may be coupled to the rotatable coupling 35 that rotatably couples the housing 32 to the base 34, allowing the housing 32 to be rotated to adjust the orientation of the first, second, and third antennas 36, 38, and 40 in unison. A rotational movement mechanism 52 is provided which may include one or more actuators which can be used to rotate the housing 32. FIG. 6D is a non-exploded view of the exemplary housing 32 and base 34 shown in FIG. 6C.

By having the housing 32 rotatably coupled to the base 34, each of the first, second, and third antennas 36, 38, and 40 may be adjusted in unison. Additionally, the first, second, and third antennas 36, 38, and 40 may be individually adjusted based on a variety of parameters, including population coverage, topography, signal path loss, antenna radiation center, gain, and/or other parameters that may help determine signal needs and antenna setup. Specific requirements for antenna steering could also be used to provide a desired rotation angle so that the sectors do not point into each other or cover the same area.

Figure 7C:
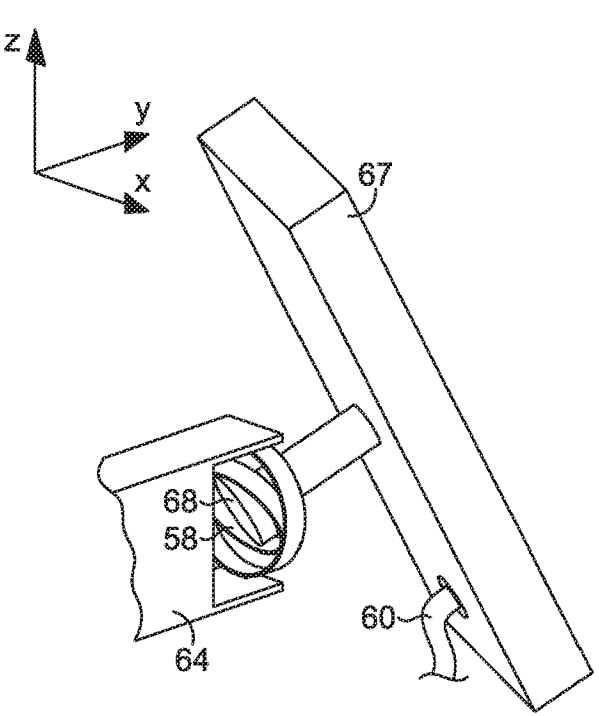
FIGS. 7A, 7B, and 7C depict exemplary movement mechanisms for antenna adjustment, in accordance with an embodiment of the present technology.
Figure 7B:
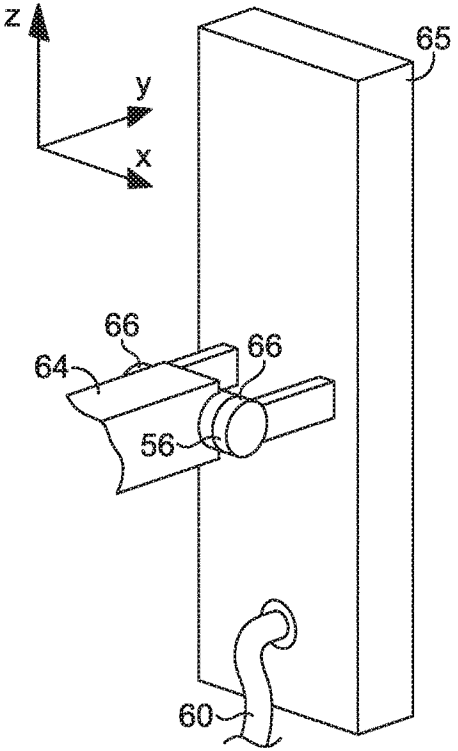
Figure 7A:
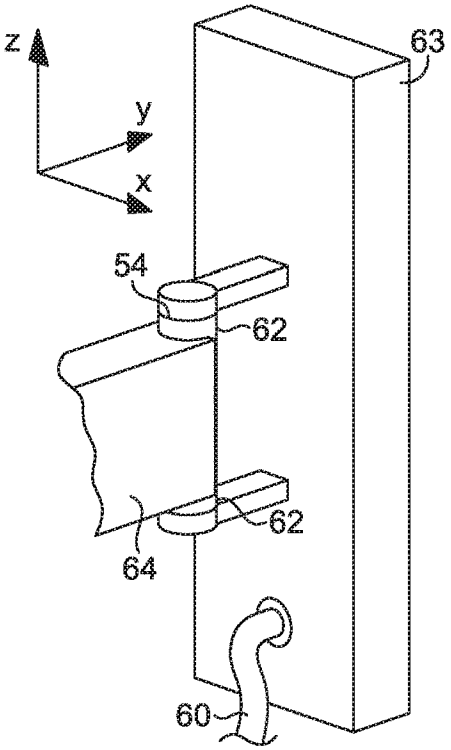

Referring to FIGS. 7A-7C, different movement mechanisms 54, 56, and 58 are provided, which can be used for adjusting the first, second, or third antennas 36, 38, and 40 shown in FIGS. 6A-6B, in accordance with an embodiment of the present technology. The movement mechanisms 54, 56, and 58 shown in FIGS. 7A-7C are intended to be exemplary and non-limiting. Each of the movement mechanisms 54, 56, and 58 may be manually adjustable, and/or may be adjusted with an actuator, such as an electric motor or other type of actuator, and may be communicatively coupled to a separate control device (not shown) with a cable 60.

Accordingly, FIG. 7A provides a first movement mechanism 54 with a rotatable coupling 62 and an actuator 64. An antenna 63 is coupled to the movement mechanism 54, and can be adjusted side-to-side in an x-y plane using the movement mechanism 54. FIG. 7B, similarly, provides a second movement mechanism 56 with a rotatable coupling 66 and an actuator 64. An antenna 65 is coupled to movement mechanism 56, which is oriented so that the antenna 65 can be adjusted in a y-z plane using the movement mechanism 56. It should be noted that the movement mechanisms 54 and 56 of FIGS. 7A and 7B may be combined into a single movement mechanism as well, to allow articulation in the x-y plane and also in the y-z plane. FIG. 7C depicts a third movement mechanism 58 with a gimbal mechanism 68 and an actuator 64. An antenna 67 is coupled to the movement mechanism 58. The gimbal mechanism 68 may further allow adjustment of the orientation of the antenna 67 in multiple directions and planes.

Figure 8A:
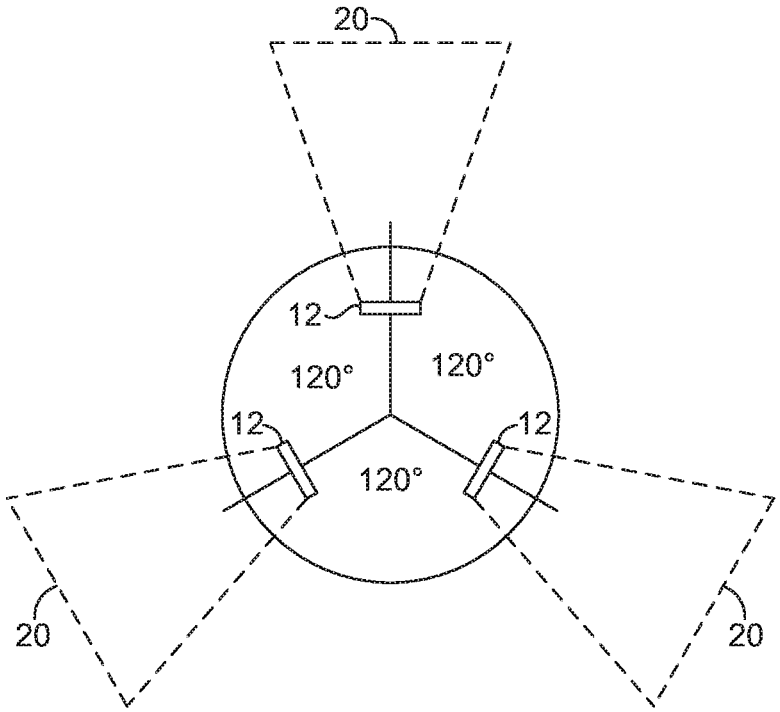
FIG. 8A depicts an exemplary orientation of sectors of coverage of a compact antenna system, in accordance with an embodiment of the present technology.
Figure 8B:
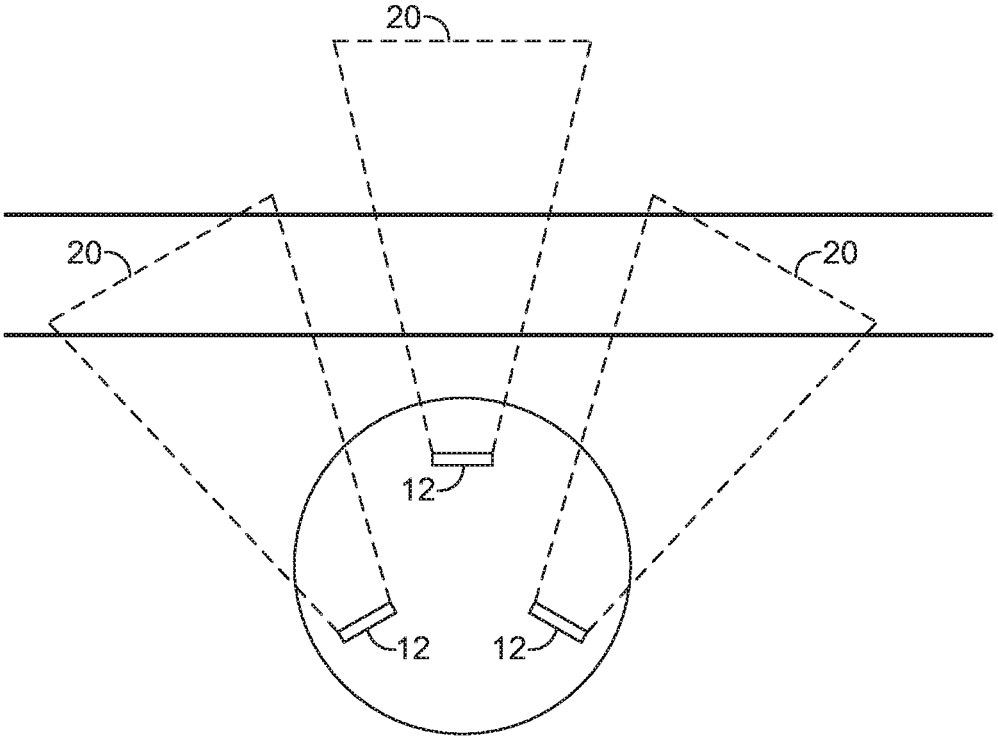
FIG. 8B depicts another exemplary orientation of sectors of coverage of a compact antenna system, in accordance with an embodiment of the present technology.

Referring to FIGS. 8A and 8B, exemplary orientations of antennas 12 in a compact antenna system, such as the compact antenna system 42 shown in FIGS. 6A-6D, is provided, in accordance with an embodiment of the present technology. Different cell sites often require different configurations of antennas to provide desired sector coverage. Factors like population density, topography, and/or geography, among others, may require adjustment of antennas to properly accommodate cell site needs. Accordingly, a compact antenna system with adjustable antennas, such as the compact antenna system 42 shown in FIGS. 6A-6D, may be used to adjust the orientation (e.g., elevation and/or azimuth) of the individual antennas 12 to provide multi-band and multi-sector operation as needed without a custom designed, fixed system for each site.

As an example, the antennas 12 may be moved in unison through rotation of the housing to a point at which the antennas are most closely aligned with desired sectors of coverage. FIG. 8A depicts a basic 120 degree separation. The antennas 12 may further be individually adjusted to orient the sectors of coverage 20 where needed using the independently adjustable antennas 12 within the housing. FIG. 8B depicts the antennas 12 adjusted for a specific cell site. Furthermore, FIG. 8B may represent a cell site adjacent a highway, where one side of the site contains more network traffic than the other side.

Figure 9:
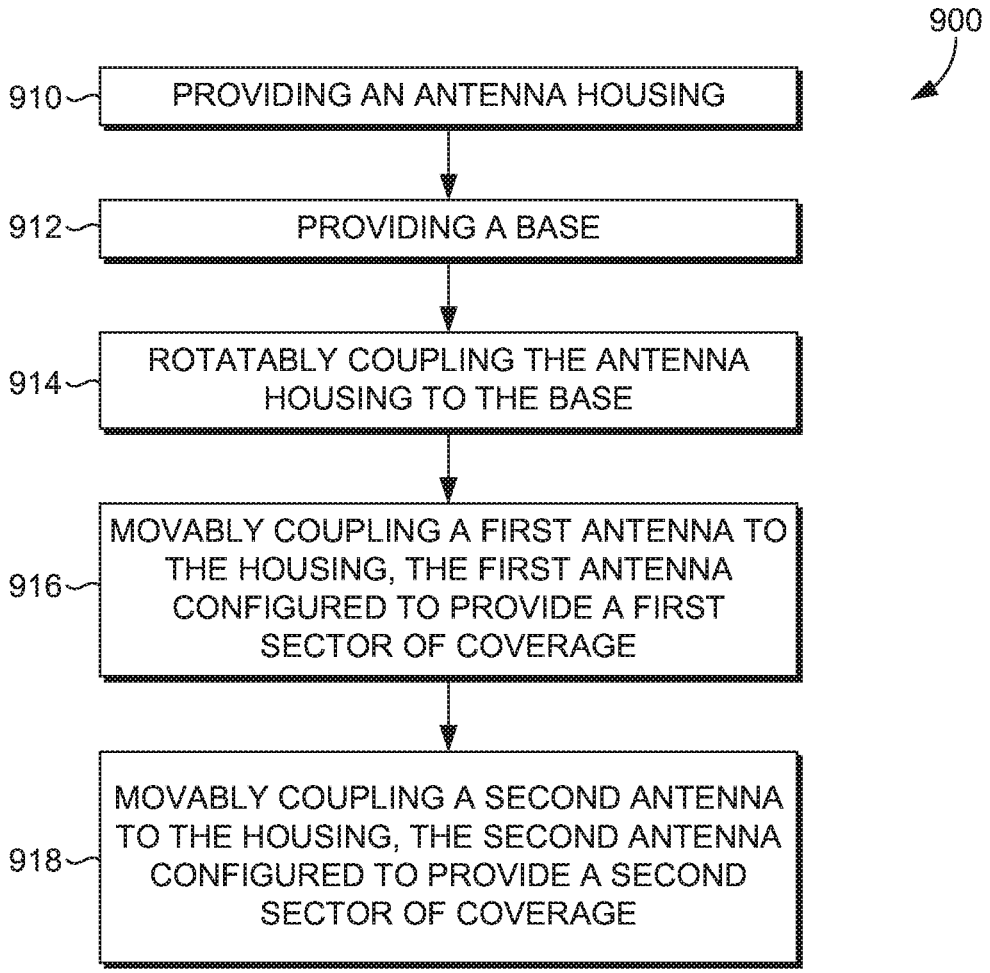
FIG. 9 is a block diagram of an exemplary method of assembling an antenna system, in accordance with an embodiment of the present technology.

Referring now to FIG. 9, a block diagram of an exemplary method 900 of assembling an antenna system for a wireless communications network is provided, in accordance with an embodiment of the present technology. At a first block 910, an antenna housing, such as the antenna housing 32 shown in FIGS. 6C-6D, is provided. At a second block 912, a base, such as the base 34 shown in FIGS. 6C-6D, is provided. At a third block 914, the antenna housing is rotatably coupled to the base. At a fourth block 916, a first antenna, such as the first antenna 36 shown in FIGS. 6A-6B, is movably coupled to the housing, the first antenna configured to provide a first sector of coverage. At a fifth block 918, a second antenna, such as the second antenna 38 shown in FIGS. 6A-6B, is movably coupled to the housing, the second antenna configured to provide a second sector of coverage.

Figure 10:
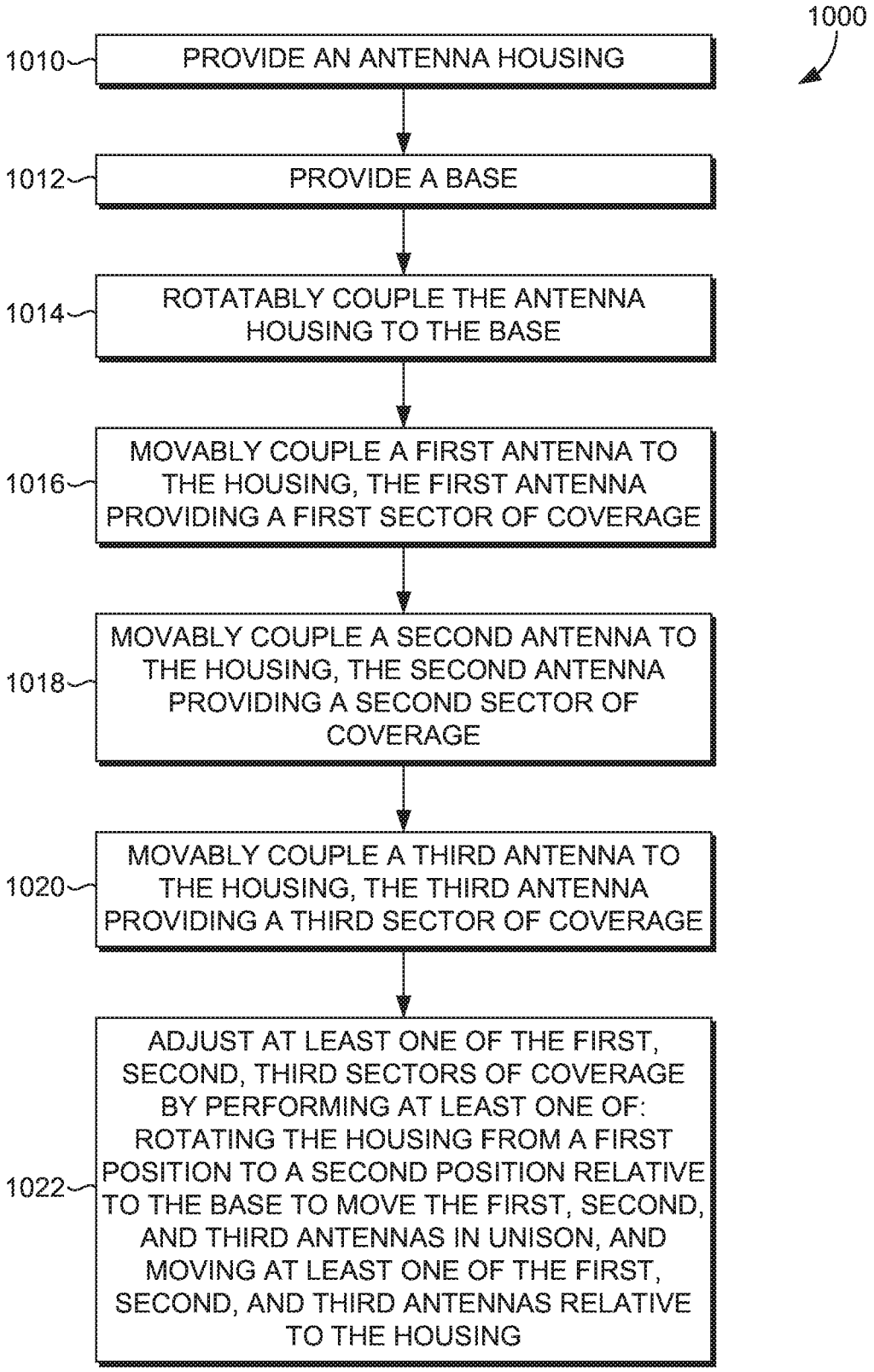
FIG. 10 is a block diagram of an exemplary method of configuring an antenna system, in accordance with an embodiment of the present technology.

Referring to FIG. 10, a block diagram of a method 1000 of configuring an antenna system in a wireless communications network is provided, in accordance with an embodiment of the present technology. At a first block 1010, an antenna housing, such as the antenna housing 32 shown in FIGS. 6C-6D, is provided. At a second block 1012, a base, such as the base 34 shown in FIGS. 6C-6D, is provided. At a third block 1014, the antenna housing is rotatably coupled to the base. At a fourth block 1016, a first antenna, such as the first antenna 36 shown in FIGS. 6A-6B, is movably coupled to the housing, the first antenna providing a first sector of coverage. At a fifth block 1018, a second antenna, such as the second antenna 38 shown in FIGS. 6A-6B, is movably coupled to the housing, the second antenna providing a second sector of coverage.

At a sixth block 1020, a third antenna, such as third antenna 40 shown in FIG. 6A-6B, is movably coupled to the housing, the third antenna providing a third sector of coverage. At a seventh block 1022, at least one of the first, second, and third sectors of coverage is adjusted by performing at least one of rotating the housing from a first position to a second position relative to the base to move the first, second, and third antennas in unison, and moving at least one of the first, second, and third antennas relative to the housing.

The compact antenna systems described herein may further be configured to allow a certain amount of flexibility for different cell site configuration requirements. For example, the number of sites where coverage sectors would be satisfied by antennas having an azimuthal difference of 120 degrees could be determined (e.g., a number of cell sites requiring only antenna housing adjustment; e.g., 29.95% of existing cell sites), and a number of sites that would require flexibility in azimuthal coverage of the individual antennas could be determined (e.g., 110-130 degrees adjustability for each antenna –47.94% of exiting cell sites; 100-140 degrees adjustability for each antenna –71.14% of existing cell sites; 90-150 degrees adjustability for each antenna –81.73% of existing cell sites; 80-160 degrees adjustability for each antenna –90.67% of existing cell sites; 70-170 degrees adjustability for each antenna –93.93% of existing cell sites). For the latter, the azimuthal adjustability of the antennas that is needed may be used to determine the size, complexity, and cost of the corresponding antenna system, as greater azimuthal adjustability may require more space for movement of the antenna within the housing.

The present technology has been described in relation to particular embodiments, which are intended in all respects to be illustrative rather than restrictive. Alternative embodiments will become apparent to those of ordinary skill in the art to which the present technology pertains without departing from its scope. Different combinations of elements, as well as use of elements not shown, are possible and contemplated.

What is claimed is:

1. A method of assembling an adjustable antenna system, the method comprising:

coupling a support structure to a base with a rotatable coupling;

coupling a first antenna to the support structure with a first movable coupling, the first antenna configured to provide a first sector of coverage;

coupling a second antenna to the support structure with a second movable coupling, the second antenna configured to provide a second sector of coverage; and at least partially enclosing the first antenna and the second antenna within a housing, wherein the first antenna and the second antenna are rotatable in unison about a central axis of the housing through rotation of the support structure on the base, and wherein the first antenna and the second antenna are independently movable relative to the support structure using their respective first movable coupling and second movable coupling.

2. The method of claim 1, further comprising:

coupling the first antenna to a first movement mechanism operable to change an orientation of the first antenna, and coupling the second antenna to a second movement mechanism operable to change an orientation of the second antenna.

3. The method of claim 2, further comprising coupling the support structure to a rotational actuator operable to rotate the support structure on the base.

4. The method of claim 3, further comprising rotating the first antenna and the second antenna in unison by operating the rotational actuator.

5. The method of claim 3, further comprising adjusting the orientation of the first antenna using the first movement mechanism.

6. The method of claim 3, further comprising adjusting the orientation of the second antenna using the second movement mechanism.

7. The method of claim 3, further comprising communicatively connecting a control device to a first actuator coupled to the first movement mechanism and to a second actuator coupled to the second movement mechanism.

8. The method of claim 1, further comprising adjusting an azimuth and/or an elevation of the first antenna independently of the second antenna.

9. The method of claim 1, further comprising adjusting an azimuth and/or an elevation of the second antenna independently of the first antenna.

10. The method of claim 1, wherein the housing comprises a radome or a canister, and wherein the first antenna and the second antenna are fully enclosed within the radome or the canister.

11. A method of configuring an adjustable antenna system, the method comprising:

coupling a support structure to a base with a rotatable coupling;

coupling a first antenna to the support structure with a first movable coupling, the first antenna configured to provide a first sector of coverage; and coupling a second antenna to the support structure with a second movable coupling, the second antenna configured to provide a second sector of coverage, wherein the first antenna and the second antenna are rotatable in unison about a central axis through rotation of the support structure on the base, and wherein the first antenna and the second antenna are independently movable relative to the support structure using their respective first movable coupling and second movable coupling.

12. The method of claim 11, further comprising attaching the rotatable coupling to a rotational actuator operable to rotate the support structure on the base.

13. The method of claim 12, further comprising:

coupling the first antenna to a first movement mechanism operable to change an orientation of the first antenna, and coupling the second antenna to a second movement mechanism operable to change an orientation of the second antenna.

14. The method of claim 13, wherein the first movement mechanism comprises a first actuator, and wherein the second movement mechanism comprises a second actuator.

15. The method of claim 14, further comprising rotating the first antenna and the second antenna in unison by operating the rotational actuator.

16. The method of claim 14, further comprising adjusting the orientation of the first antenna using the first movement mechanism.

17. The method of claim 14, further comprising adjusting the orientation of the second antenna using the second movement mechanism.

18. The method of claim 11, further comprising enclosing, at least partially, the first antenna and the second antenna within a housing.

19. The method of claim 18, wherein the housing comprises a rounded housing.

20. The method of claim 18, further comprising coupling the housing to the base.

* * * * *